US005098264A

United States Patent [19]

Lew

[11] Patent Number: 5,098,264

[45] Date of Patent: Mar. 24, 1992

[54] YIN-YANG FLUID POWER MACHINE

[76] Inventor: Hyok S. Lew, 7890 Oak St., Arvada, Colo. 80005

[21] Appl. No.: 527,523

[22] Filed: May 23, 1990

Related U.S. Application Data

[63] Continuation-in-part of Ser. No. 375,466, Jul. 5, 1989, Pat. No. 5,051,078.

[51] Int. Cl.[5] ..... F03D 7/06; F04C 2/00

[52] U.S. Cl. ..... 418/23; 418/268; 416/87; 416/119

[58] Field of Search ..... 418/23, 268, 260, 263; 73/189, 861.85, 861.86, 861.87; 416/17, 87, 119

[56] References Cited

U.S. PATENT DOCUMENTS

| | | | |
|---|---|---|---|
| 4,048,947 | 9/1977 | Sicard | 416/119 |
| 4,265,086 | 5/1981 | Bahrenburg | 416/119 |
| 4,383,801 | 5/1983 | Pryor | 416/119 |
| 4,415,322 | 11/1983 | Baudin | 418/260 |
| 4,451,215 | 5/1984 | Winkler et al. | 418/260 |
| 4,494,007 | 1/1985 | Gaston | 416/119 |
| 4,618,312 | 10/1986 | Williams | 416/119 |
| 4,686,586 | 3/1987 | Lew | 418/268 |
| 4,765,185 | 8/1988 | Lew | 73/260 |
| 4,776,762 | 10/1988 | Blowers, Sr. | 416/119 |

*Primary Examiner*—Richard A. Bertsch
*Assistant Examiner*—David L. Cavanaugh

[57] ABSTRACT

An apparatus harnessing energy belonging to fluid stream comprises a plurality of elongated fluid dynamic force receiving members with cambered cross sections disposed parallel to and about a shaft and supported by at least one hub member affixed to the shaft wherein the individual fluid dynamic force receiving member is secured to the hub member in a pivotable arrangement about a pivot axis disposed near one extremity thereof in a parallel relationship to the shaft, and at least one circular cam guide disposed on a plane perpendicular to the shaft that is engaged by a plurality of cam followers respectively secured to the plurality of elongated fluid dynamic force receiving members.

11 Claims, 2 Drawing Sheets

YIN-YANG FLUID POWER MACHINE

BACKGROUND OF THE INVENTION

This is a continuation-in-part application to Ser. No. 07/375,466 entitled "Rotary Pump-Flowmeter" filed on July 5, 1989, now Pat. No. 5,051,078.

Many scientists and engineers working on apparatus harnessing renewable energy resources such as solar energy and wind energy tend to over-emphasize the operating efficiency of the apparatus and often invent or experiment with Rube Goldberg type devices which have little practical value. As sunlight and wind are there free of charge, one does not worry about the operating efficiency of the apparatus as long as the apparatus are reasonably inexpensive, simple in construction and actually work. There are only a few locations in a country where a strong wind blows most of the time, while many areas usually have winds of low to moderate velocity. In general, a more logical and practical apparoach in collecting and using solar energy and wind energy is to construct and distribute many small units in such a way that the renewable energy resources are collected at the very locations where the collected energy is to be consumed rather than installing a large energy gathering facility at a choice site and supplying the collected energy over a long distance to the users. In order to meet the above-mentioned norm for harnessing renewable energy resources, the collecting apparatus must be capable of collecting the renewable energy resources at all intensities and more particularly those of low intensities, as renewable energy resources of low intensities are more often available over wide areas.

BRIEF SUMMARY OF THE INVENTION

The primary object of the present invention is to provide a fluid power machine and more particularly a windmill that collects energy from low velocity winds as well as high velocity winds.

Another object is to provide a fluid power machine that has a high power to sweep volume ratio.

A further object is to provide a fluid power machine comprising a plurality of elongated fluid dynamic force receiving members with cambered cross sections disposed about the power shaft of the fluid power machine and secured to one or more hub members included in the power shaft at the first edges thereof in a pivotable arrangement wherein the second edges of the elongated members form a generally circular cylindrical surface when the elongated members are folded towards the power shaft into an exisymmetric distribution about the power shaft, and one or more generally circular cam guides disposed on a plane perpendicular to the power shaft and engaged by a plurality of cam followers included in one or both extremities of the elongated fluid dynamic force receiving members.

These and other objects of the present invention will become clear as the description thereof progresses.

BRIEF DESCRIPTION OF THE FIGURES

The present invention may be described with a greater clarity and specificity by referring to the following figures.

DESCTIPTION OF THE ILLUSTRATED EMBODIMENTS

Figure 1:
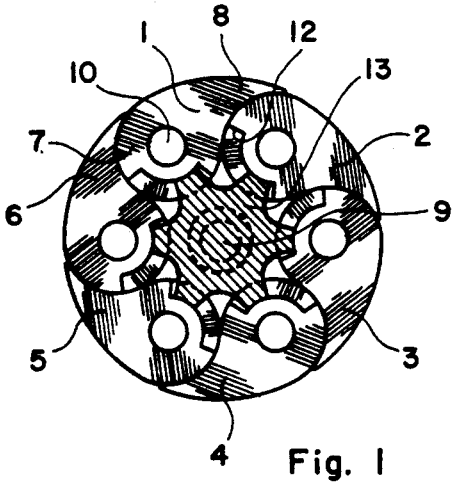
FIG. 1 illustrates an end view of an embodiment of the assembly of the elongated fluid dynamic force receiving members having a cross section similar to the Yin-Yang symbol, which are disposed axisymmetrically about the power shaft of the fluid power machine.

In FIG. 1 there is illustrated an embodiment of the assembly of elongated fluid dynamic force receiving members 1, 2, 3, 4, 5, 6, etc., each of which has a cross section similar to the Yin-Yang symbol including a round first edge 7 and a crescent second edge 8. The plurality of elongated force receiving members are disposed parallel to and about the fluid machine power shaft 9 in an arrangement wherein the round first edges of the elongated fluid dynamic force receiving members are disposed adjacent to the power shaft 9 and supported by one or more hub members affixed to the power shaft (the hub member that is not shown in FIGS. 1, 2 and 3 appears in FIG. 4) in a pivotable arrangement about the center of radius of the round first edge 7 as a plurality of journals disposed axisymmetrically about the shaft and affixed to the hub member engage bearings 10 included in the round first edges of the fluid dynamic force receiving members. The round first edges of the fluid dynamic force receiving members may include pockets 11 circumferentially disposed about the journals or bearings 10, each of which pockets is engaged by each of a plurality of stops 12 radially extending from the power shaft 9. Each of the elongated fluid dynamic force receiving members 1, 2, 3, 4, 5, 6, etc., are allowed to pivot about the pivot axis 10 disposed at the center of radius of the round first edge thereof in a parallel arrangement to the power shaft 9 between the fully extended position set by the combination of the pocket 12 and stop 13 and the fully folded position. It is readily noticed that the outer perimeter of the assembly of the elongated fluid dynamic force receiving members becomes a generally circular cylindrical surface, when all of the elongated fluid dynamic force receiving members take fully folded positions.

Figure 2:
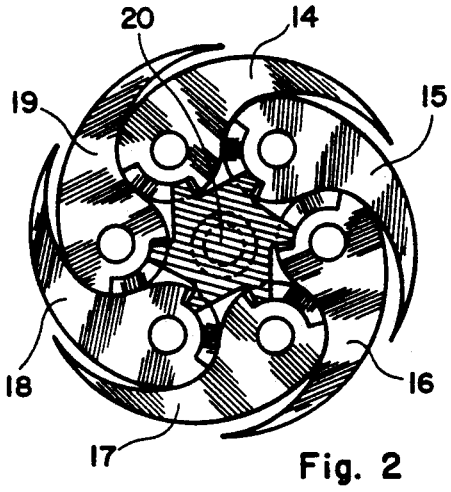
FIG. 2 illustrates an end view of another embodiment of the assembly of the elongated fluid dynamic force receiving member having a cross section similar to the Yin-Yang symbol, which make up the blades of the fluid power machine.

In FIG. 2 there is illustrated another embodiment of the assembly of elongated fluid dynamic force receiving members 14, 15, 16, 17, 18, 19, etc., having cross sections resembling the Yin-Yang symbol, which are disposed parallel to and about the power shaft 20 and supported thereby in an arrangement essentially the same as that of the embodiment shown in FIG. 1. The individual fluid dynamic force receiving member employed in this embodiment has a much longer crescent edge extending from the round edge compared with the equivalent element included in the embodiment shown in FIG. 1.

Figure 3:
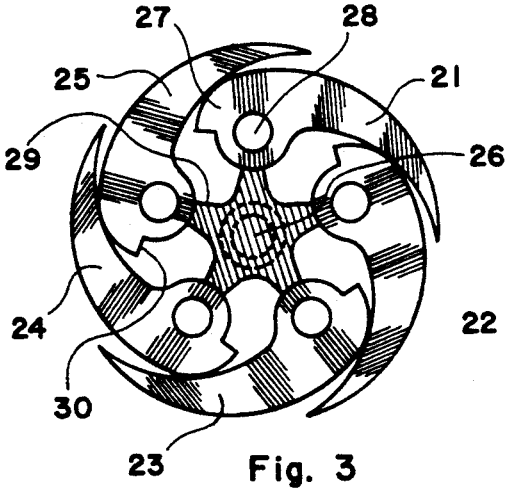
FIG. 3 illustrates an end view of a further embodiment of the assembly of the elongated fluid dynamic force receiving members having a cambered cross section, which make up the blades of the fluid power machine.

In FIG. 3 there is illustrated a further embodiment of the assembly of elongated fluid dynamic force receiving members 21, 22, 23, 24, 25, etc., with cambered cross sections, which are disposed parallel to and about the power shaft 26 and supported thereby in an arrangement wherein the first edge 27 of the individual fluid dynamic force receiving member disposed adjacent to the power shaft 26 is pivotable about the central axis of the journal or bearing 28 included in the first edge 27 in a parallel relationship to the power shaft 26. The maximum extent of the extension of the individual fluid dynamic force receiving member is set by the stop 29 extending from the power shaft 26 catching the step 30 included in the first edge of the fluid dynamic force receiving member. It is again noticed that the assembly of the elongated fluid dynamic force receiving members 21, 22, 23, 24, 25, etc., fold into a geometry having the outer perimeter thereof generally coinciding with a circular cylindrical surface.

Figure 4:
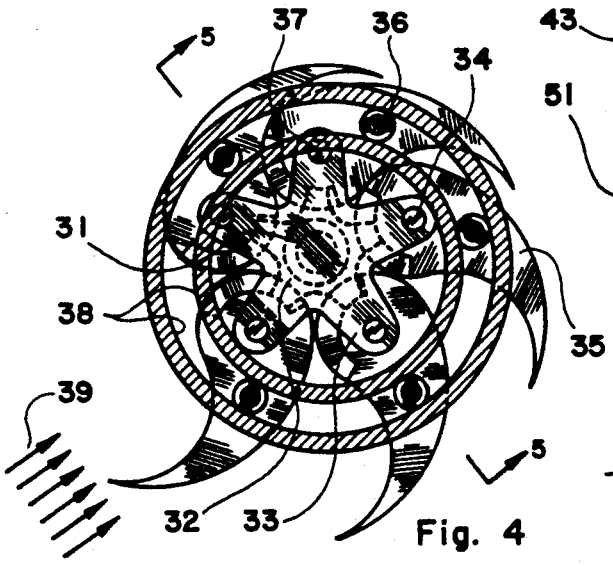
FIG. 4 illustrates an end view of an embodiment of the fluid power machine of the present invention that employs the assembly of elongated fluid dynamic force receiving members such as that shown in FIG. 1, 2 or 3.

In FIG. 4 there is illustrated an end view of the Yin-Yang fluid power machine constructed in accordance with the principles of the present invention, which employs one of the assembly of elongated fluid dynamic force receiving members shown in FIGS. 1, 2 and 3. The hollow power shaft 31 includes at least one hub member 32 comprising a plurality of lobed extensions 33 radially extending therefrom, each of which lobed extension supports the journal or bearing included in the first edge 34 of the elongated fluid dynamic force receiving member 35 with cambered cross section. Each of the fluid dynamic force receiving members includes at least one cam follower 36 with central axis parallel to the power shaft 31 and off set from the journal or bearing 37 providing the pivoting movement of the fluid dynamic force receiving member, which cam follower is affixed to the individual fluid dynamic force receiving member preferably at the edge thereof. The plurality of the cam followers included in the fluid dynamic force receiving members engage at least one circular cam guide 38 that is supported by the cam followers in a freely shiftable arrangement. The shifting movement of the circular cam guide 38 is controlled by the direction of fluid stream 39 that turns the fluid power machine shown in FIG. 4 about the central axis of the power shaft 31. It should be mentioned that the maximum extent of the extension or unfolding of the individual elongated fluid dynamic force receiving member with cambered cross section is set by the stops built into the hub member 32 and the first edges of the elongated fluid dynamic force receiving members as described in conjunction with FIGS. 1, 2 and 3.

Figure 5:
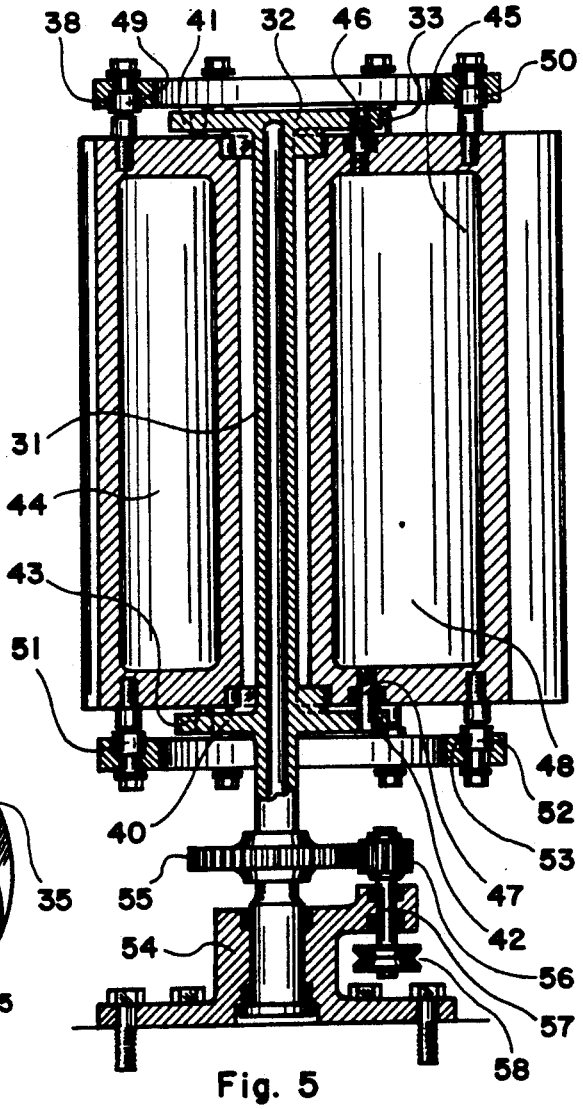
FIG. 5 illustrates a cross section of the fluid power machine shown in FIG. 4.

In FIG. 5 there is illustrated a cross section of the embodiment shown in FIG. 4, which cross section is taken along plane 5—5 as shown in FIG. 4. In this particular illustrative embodiment, the hollow power shaft 31 includes a pair of hub members 32 and 40 affixed thereto, which comprises lobed extensions 33, 41 and 42, 43, etc. The elongated fluid dynamic force receiving members 44, 45, etc. are supported by the pair of hub members 32 and 40 in a pivotable arrangement about the axes of the journals or bearings 46, 47, etc. The round first edge of the elongated fluid dynamic force receiving member may have hollow cores 48. Of course, the fluid dynamic force receiving members of construction shown in FIG. 3 may not need any construction of hollow core design. The cam followers 49, 50, etc. disposed on one extremities of the fluid dynamic force receiving members follow the first circular cam guide 38, while the cam followers 51, 52, etc. disposed on the other extremities of the fluid dynamic force receiving members follow the second circular cam guide 53. In an alternative design, a single circular cam guide may be disposed at the half-way section between the two extremities of the assembly of fluid dynamic force receiving members, wherein the cam follows disposed in a cut-outs extending across the crescent edges of the fluid dynamic force receiving members engage the circular cam guide. The hollow power shaft 31 is rotatably supported by a base structure 54. The gear 55 affixedly mounted on the power shaft 31 engages the pinion gear 56 affixedly mounted on the power-take-off shaft 57 which includes a drive pulley 58 or drive gear, by which the power generated by the fluid power machine is taken off.

Figure 6:
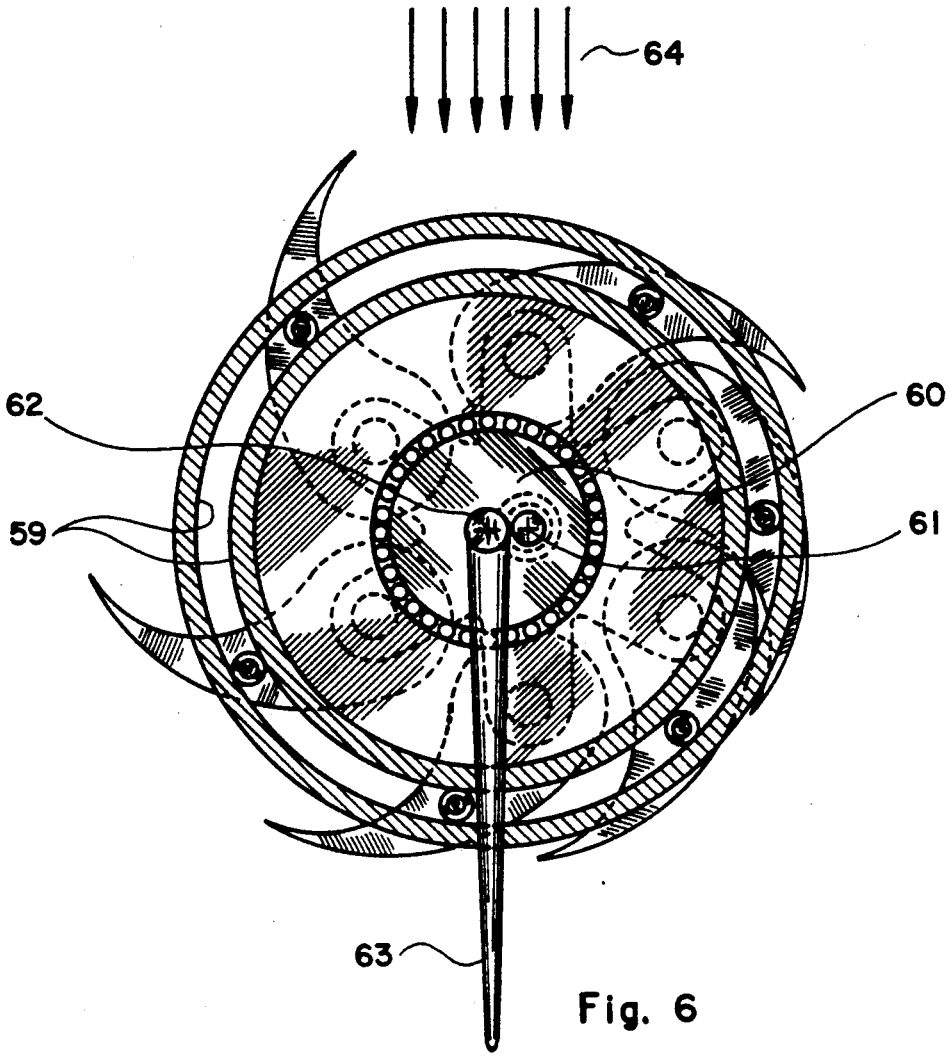
FIG. 6 illustrates a revised version of the embodiment shown in FIG. 4.
Figure 7:
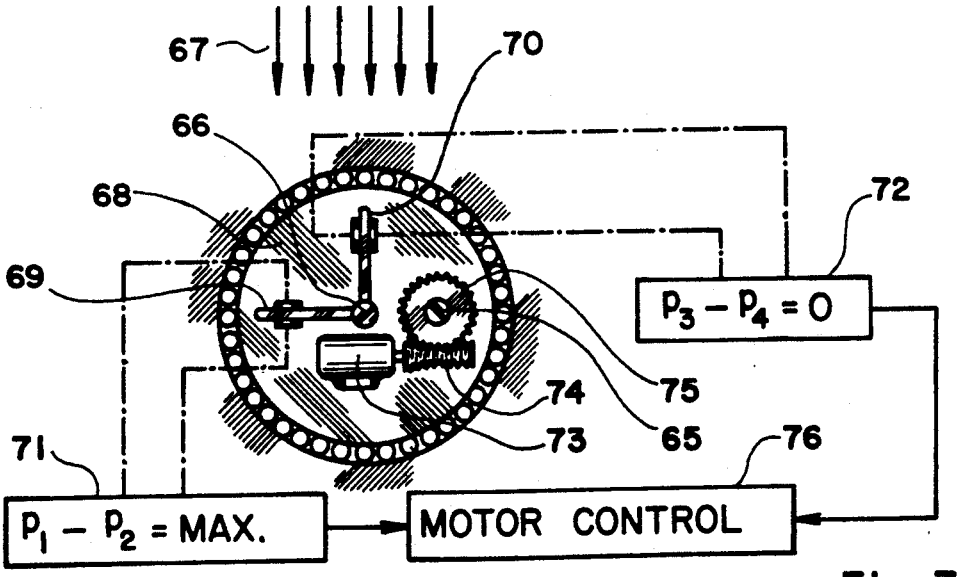
FIG. 7 illustrates an embodiment of the electromechanical device orienting the fluid power machine in relation to the direction of fluid stream.

When the fluid power machine of the present invention is used as a windmill, the power shaft 31 should be disposed in a vertical position, whereby the shifting wind direction shifts the position of the circular cam guides on horizontal planes and automatically adjusts the folding and unfolding movements of the fluid dynamic force receiving members in such a way that the momentum of the wind generates the maximum power from the windmill independent of the wind direction. When the fluid power machine of the present invention is used to generate power from a fluid stream of fixed direction, the power shaft 31 may be disposed in any position on a plane generally perpendicular to the direction of fluid stream. As a revision of the embodiment of the fluid power machine shown in FIGS. 4 and 5, the circular cam guides 38 and 53 may be rotatably supported by a holder member rotatable about the central axis of the power shaft in an arrangement wherein the circular cam guides are freely rotatable about the central axis of the circular cam guide parallel to and off set from the central axis of the power shaft, wherein a plane including the central axis of the power shaft and the central axis of the circular cam guide is oriented generally perpendicular to the direction of fluid stream. As a further revision, the above-described revised version may comprise an active means including a flow direction sensor and powered actuator or a passive means including a fin that automatically sets the orientation of the plane including the above-mentioned two axes generally perpendicular to the direction of fluid stream, which revised version is shown in FIGS. 6 and 7. The operating principles of the fluid power machine of the present invention become immediately clear from FIG. 4. The circular cam guide 38 couples the folding and unfolding movement of the fluid dynamic force receiving members in such a way that unfolding movement of one fluid dynamic force receiving member under the lift or drag force of the fluid stream, which generate rotating motion of the fluid power machine in counter-clockwise direction in the particular illustrative embodiment shown in FIG. 4, results in the folding movement of another fluid dynamic force receiving member located diametrically opposite to the unfolding fluid dynamic force receiving member, which action is cyclically repeated in an alternating manner as the fluid stream rotates the fluid power machine. When the fluid power machine is used as an emergency or temporary power source and requires a portability, the circular cam guides can be assembled to the assembly of fluid dynamic force receiving members in an easily removable design, whereby the assembly of fluid dynamic force receiving members can be folded into a circular cylindrical shape for easy transportation.

In FIG. 6 there is illustrated a revised version of the embodiment of the fluid power machine shown in FIG. 4. In this embodiment, the circular cam guide 59 playing the same role as the element 38 shown in FIG. 4 is rotatably supported by a holder member 60 that is rotatable about the central axis of the power shaft 61 in an arrangement wherein the circular cam guide 59 is freely rotatable about an axis 62 parallel to and off set from the central axis of the power shaft 61. The holder member 60 includes a fin 63 disposed on a plane parallel to the power shaft 61 and extending from the central portion of the holder member 60 in a direction generally perpendicular to a plane including the central axis of the power shaft 61 and the central axis 62 of the circular cam guide 59. The fluid dynamic force on the fin 63 automatically orientates the plane including the central axis of the power shaft 61 and the central axis of the circular cam guide 59 generally perpendicular to the direction of fluid stream 64.

In FIG. 7 there is illustrated an embodiment of the electro-mechanical device that may be employed in place of the fin 63 shown in FIG. 6 for automatically orienting the plane including the central axis of the power shaft 65 and the central axis 66 of the circular cam guide generally perpendicular to the direction of fluid stream 67. The holder member 68 rotatably supporting the circular cam guide includes a first planar member 69 disposed parallel to the power shaft 65 and parallel to the plane including the central axis of the power shaft 65 and the central axis 66 of the circular cam guide, and a second planar member 70 disposed parallel to the power shaft 65 and perpendicular to the first planar member 69, wherein the two planar members 69 and 70 respectively include two differential pressure sensors 71 and 72 measuring pressure difference between the two opposite sides thereof. The orientation control motor 73 mounted on the holder member 68 includes a worm gear 74 engaging a pinion gear 75 rotatably mounted on an extension of the power shaft 65 and nonrotatably affixed to a stationary member that is not shown in the illustrated embodiment for the brevity of the illustration. When the differential pressure sensor 71 detects that the pressure $p_1$ is greater than the pressure $p_2$, and the differential pressure sensor 72 detects that the pressure $p_3$ is greater than the pressure $p_4$, the motor control 76 supplies the direct electric current to the dc motor 73 in a direction that rotates the holder member 68 about the power shaft 65 in the clockwise direction until the the value of differential pressure $(p_3-p_4)$ vanishes and the value of the differential pressure $(p_1-p_2)$ becomes maximum. When the differential pressure sensor 71 detects that the pressure $p_1$ is greater than the pressure $p_2$, and the differential pressure sensor 72 detects that the pressure $p_3$ is less than the pressure $p_4$, the motor control 76 supplies the direct electric current to the dc motor 73 in the other direction that rotates the holder member 68 in the counter-clockwise direction until the differential pressure $(p_1-p_2)$ becomes maximum and the differential pressure $(p_3-p_4)$ vanishes. When the differential pressure sensor 71 detects that the pressure $p_1$ is less than the pressure $p_2$, the motor control rotates the the holder member 68 in either direction until the differential pressure $(p_1-p_2)$ becomes maximum and the differential pressure $(p_3-p_4)$ vanishes. The motor control 76 maintains the orientation of the holder member 68 in relation to the direction of fluid stream 67 whereat the differential pressure across the first planar member 69 is maximum and the differential pressure across the second planar member 70 vanishes, which action automatically orientates the plane including the central axis of the power shaft 65 and the central axis of the circular cam guide generally perpendicular to the direction of fluid stream 67. It should be mentioned that the bearings providing free rotation between the circular cam guide and the holder member included in the embodiments shown in FIGS. 6 and 7 may be omitted in an alternative design, wherein the circular cam guide does not rotate following the orbiting motions of the cam followers.

While the principles of the present inventions have now been made clear by the illustrative embodiments, there will be many modifications of the structures, arrangements, proportions, elements and materials obvious to those skilled in the art, which are particularly adapted to the specific working environments and operating conditions in the practice of the inventions without departing from those principles. It is not desired to limit the inventions to the particular illustrative embodiments shown and described and, accordingly, all suitable modifications and equivalents may be regarded as falling within the scope of the inventions as defined by the claims which follow.

The embodiments of the invention, in which an exclusive property or priviledge is claimed, are defined as follows:

1. An apparatus for harnessing energy belonging to fluid stream comprising in combination:

a) a hub structure rotatably supported by a supporting structure, said hub structure including at least one hub member; said hub structure rotatable about a fixed shaft axis;

b) a plurality of fluid dynamic force receiving members having cambered cross sections disposed generally parallel to said shaft axis in a circumferentially distributed arrangement about said shaft axis, and pivotably supported by said at least one hub member wherein each of the plurality of fluid dynamic force receiving members is pivotable about each of a plurality of pivot axes disposed axisymmetrically about said shaft axis and disposed adjacent and substantially parallel to one edge of said each of the plurality of fluid dynamic force receiving members; whereby the plurality of fluid dynamic force receiving members fold towards and unfold away from said shaft axis;

c) at least one circular cam guide disposed about said shaft axis on a plane substantially perpendicular to said shaft axis said cam guide having a cam guide axis eccentric from shaft axis, said cam guide axis is movable about the shaft axis such that a plane formed by said cam guide axis and shaft axis faces the direction of the fluid stream;

d) a plurality of cam followers engaging said at least one circular cam guide, one each of the plurality of cam followers secured to each of said plurality of fluid dynamic force receiving members in an off-set arrangement from the pivot axis of said each of the plurality of fluid dynamic force receiving members, wherein an unfolding movement of one of said plurality of fluid dynamic force receiving members and a folding movement of the other of said plurality of fluid dynamic force receiving members located diametrically opposite to said one of the plurality of fluid dynamic force receiving members become coupled to one another by said at least one circular cam guide; and e) means for transmitting rotating motion of said hub member to a device driven by said apparatus.

2. A combination as set forth in claim 1 wherein each of said fluid dynamic force receiving members includes means limiting the extent of unfolding movement thereof.

3. An apparatus for harnessing energy belonging to fluid stream comprising in combination:

a) a hub structure rotatably supported by a supporting structure, said hub structure including at least one hub member said hub structure rotatable about a fixed shaft axis;

b) a plurality of fluid dynamic force receiving members having cambered cross sections disposed generally parallel to said shaft axis in a circumferentially distributed arrangement about said shaft axis, and pivotably supported by said at least one hub member wherein each of the plurality of fluid dynamic force receiving members is pivotable about each of a plurality of pivot axes disposed axisymmetrically about said shaft axis and disposed adjacent and substantially parallel to one edge of said each of the plurality of fluid dynamic force receiving members; whereby the plurality of fluid dynamic force receiving members fold towards and unfold away from said shaft axis;

c) at least one circular cam guide disposed about said shaft axis on a plane substantially perpendicular to said shaft axis said circular cam guide means centered upon a cam guide axis, said cam guide axis disposed in an eccentric and parallel relationship to said shaft axis in a rotatable arrangement about said shaft axis;

d) a plurality of cam followers engaging said at least one circular cam guide, one each of the plurality of cam followers secured to each of said plurality of fluid dynamic force receiving members in an off-set arrangement from the pivot axis of said each of the plurality of fluid dynamic force receiving members, wherein an unfolding movement of one of said plurality of fluid dynamic force receiving members and a folding movement of the other of said plurality of fluid dynamic force receiving members located diametrically opposite to said one of the plurality of fluid dynamic force receiving members become coupled to one another by said at least one circular cam guide; and e) rotating the cam guide axis about the shaft axis such that a plane formed by the cam guide axis and the shaft axis is oriented in a position generally perpendicular to the direction of fluid stream; and f) means for transmitting rotating motion of said hub member to a device driven by said apparatus.

4. A combination as set forth in claim 3 wherein each of said fluid dynamic force receiving members includes means limiting the extent of unfolding movement thereof.

5. A combination as set forth in claim 3 wherein said at least one circular cam guide is rotatable about the central axis thereof relative to a central portion of a cam guide holder supporting said at least one circular cam guide and disposed rotatably about said shaft.

6. A combination as set forth in claim 3 wherein said means for lining up said hypothetical plane comprises a rudder affixed to and extending in a parallel relationship to said shaft from a central portion of a cam guide holder supporting said at least one circular cam guide and disposed rotatably about said shaft.

7. A combination as set forth in claim 6 wherein each of said fluid dynamic force receiving members includes means limiting the extent of unfolding movement thereof.

8. A combination as set forth in claim 6 wherein said at least one circular cam guide is rotatable about the central axis thereof relative to a central portion of a cam guide holder supporting said at least one circular cam guide and disposed rotatably about said shaft.

9. A combination as set forth in claim 3 wherein said means for lining up said hypothetical plane comprises a wind direction detecting means and an electric motor controlled by said wind direction detecting means, wherein the electric motor rotates a central portion of a cam guide holder supporting said at least one circular cam guide and disposed rotatably about said shaft about said shaft until said hypothetical plane becomes lined up generally perpendicular to the wind direction.

10. A combination as set forth in claim 9 wherein each of said fluid dynamic force receiving members includes means limiting the extent of unfolding movement thereof.

11. A combination as set forth in claim 9 wherein said at least one circular cam guide is rotatable about the central axis thereof relative to a central portion of a cam guide holder supporting said at least one circular cam guide and disposed rotatably about said shaft.

* * * * *